United States Patent [19]

Peterson et al.

[11] 4,211,503

[45] Jul. 8, 1980

[54] BIMETALLIC CORROSION RESISTANT STRUCTURAL JOINT AND METHOD OF MAKING SAME

[75] Inventors: Marvin L. Peterson; Orwin G. Maxson, both of Ponca City, Okla.

[73] Assignee: Conoco, Inc., Ponca City, Okla.

[21] Appl. No.: 960,348

[22] Filed: Nov. 13, 1978

[51] Int. Cl.[2] ..... E02D 5/60

[52] U.S. Cl. ..... 405/216; 52/728; 405/195

[58] Field of Search ..... 405/216, 251, 250, 252, 405/211, 195; 52/725, 726, 727, 728

[56] References Cited

U.S. PATENT DOCUMENTS

| | | | |
|---|---|---|---|
| 646,970 | 4/1900 | Francis | 52/728 X |
| 798,384 | 8/1905 | Aylett | 405/216 |
| 910,356 | 1/1909 | Carpenter | 52/728 X |
| 2,470,149 | 5/1949 | Derby | 405/216 |
| 2,791,096 | 5/1957 | Morton et al. | 405/216 |
| 3,762,173 | 10/1973 | Marsh | 405/251 X |
| 4,053,247 | 10/1977 | Marsh | 405/252 X |

FOREIGN PATENT DOCUMENTS

| | | | |
|---|---|---|---|
| 1349404 | 12/1963 | France | 405/216 |

*Primary Examiner*—Dennis L. Taylor

*Attorney, Agent, or Firm*—A. Joe Reinert

[57] ABSTRACT

A corrosion resistant bimetallic structure which includes a pair of butt-welded steel elements having protected surfaces extending to the weld; spaced, protective overlays of corrosion resistant non-ferrous metal joined to portions of the protected surface of each steel element on opposed sides of the weld; and a non-ferrous metal bridging plate bridging the weld and joined to outer sides of the spaced protective overlays by welds using said corrosion resistant non-ferrous metal as the weld metal. The space between the bridging plate, the spaced ends of the protective layers and the steel elements adjacent the weld is sealed against ingress of corrosive liquid.

In a method of making the described structure, the steel elements are welded in end-to-end alignment. Sections of each element spaced from the weld are then encased with a corrosion resistant non-ferrous metal. Each metal encasement is sealed against the steel, and the gap between the ends of the encasing sections of non-ferrous metal is filled with a secondary sealing material, such as an epoxy grout. Finally, the seals and weld are protectively enclosed under a bridging plate of the non-ferrous metal by welding the bridging plate to exposed surfaces of the non-ferrous metal encasements.

20 Claims, 2 Drawing Figures

BIMETALLIC CORROSION RESISTANT STRUCTURAL JOINT AND METHOD OF MAKING SAME

BACKGROUND OF THE INVENTION

1. Field of the Invention

This invention relates to corrosion resistant structural systems, and more particularly, to bimetallic systems in which steel is protected from corrosion resulting from intermittent contact with salt water by a protective non-ferrous overlay.

2. Brief Description of the Prior Art

Offshore drilling and oil production platform steel structural members are subject to severe corrosion at the location where these members pass beneath the surface of the water. This zone, referred to as the splash zone, presents a special problem in corrosion of the steel structural elements because they are here subjected to intermittent contact with salt water, salt-laden spray or mist, and air. The exposed surfaces are alternately wet and dry, and the sea water, as well as the mist, is saturated with oxygen. These conditions are conducive to rapid and severe corrosion of the steel structures.

Although effective protective coatings of organic composition can be applied to the steel members at locations elevated above the splash zone, and such members can be cathodically protected in the zone where they are always submerged beneath the water, neither type of protection is adequate within the splash zone. Considering the amount by which the level of the surface of the water may change with changing tides, and the height to which wave crests may extend above the mean surface of the water, the splash zone may, in some instances, range over 40 feet or more along the total vertical extent of the structural member. The problem of protecting the steel structural members located in the splash zone is intensified where joinder of such members by butt welds and the like is required.

Although it has been proposed for a number of years to protect steel structures exposed to corrosion in tidal and splash zones by providing a protecting sheathing of a corrosion resistant metal, as recognized in Morton et al. U.S. Pat. No. 2,791,096, it is there further explained that such protective sheathings themselves are difficult to apply to the steel structural member without engendering offsetting, and possibly more severe, problems than the corrosion itself. Thus, as the patentees in the Morton et al. patent point out, difficulty is experienced in attaching suitable corrosion resistant metal sheathing directly to the steel substrate by welding procedures, since special welds are necessary which even under the best conditions tend to weaken the steel substrate by migration of weld metal into the intermolecular interstices of the steel. Moreover, the sheathing material itself exhibits, in most cases, a propensity to crack during installation as a result of metal contamination. Morton et al. propose to overcome the described difficulties of sheathing the steel structures with a corrosion resistant protective metal by welding steel bands to the protective sheathing and also to the steel structural member substrate. Through the use of these intermediate bands, they allege that it is possible to avoid direct welding or attachment of the corrosion resistant metal sheathing to the steel structural members to be protected. A suggested sheathing material is a nickel-copper alloy. This arrangement is stated to obviate the danger of cracking of the sheathing materials as a result of drawing certain types of metals into the sheathing material to dilute and weaken the structural characteristics of the sheathing material.

It will be apparent from the description of the Morton et al. process as disclosed in the cited patent that avoidance of weld joints between the sheathing material and steel at locations still exposed to contact with sea water and air is not obviated, since the welds between the steel bands and the cladding or sheathing materials are still fully exposed to the corrosive environment.

The protection of steel or wooden pilings in a zone bridging the water line is considered in Fox U.S. Pat. No. 4,019,301 where the patentee advocates an enclosing inert sleeve of fiberglass, epoxy or similar material, with a space being left between the sleeve and the piling. This space is filled with an epoxy grout or the like which is allowed to set up and complete the protective sheathing or covering. No welding or securement of the sleeve and grout to the metalic or wooden substrate is advocated beyond the bond which may be established between the grout and the surface of the protected structural member.

In Shaw U.S. Pat. No. 3,719,049, it is proposed to protect the metallic structural member at the location where it traverses the splash zone by wrapping the structural member with a wrapper or jacket made of a flexible material, such as rubber or neoprene, and filling an annulus provided between this jacket and the structural member with a rust inhibitor. Constrictive steel bands are used at opposite ends of the jacket or wrapper to clinch the jacket in position on the structural member, and prevent its axial displacement therealong with resulting misalignment in relation to the splash zone. A generally similar proposal for protection of the structural member at the splash zone is also described in Lidell U.S. Pat. No. 3,996,757.

In a paper entitled "The Bimetal Concept", *Welding and Metal Fortification,* November 1974, pages 379–384, G. Newcombe points out that a number of practical and metallurgical problems are encountered in the fabrication of bimetallic structures in which a non-ferrous alloy is used for cladding or sheathing a ferrous substrate, such as steel, for purposes of corrosion protection. It is important that the structure be fabricated so that continued and extended integrity of the clad or sheath layer is realized. The author points out that steel and copper alloys have a significant potential difference in sea water, and that any defect in the joinder which provides a sea water leak path to the interface between the copper alloy and the steel will initiate severe and localized attack upon the steel. It is further important that the clad or sheathed layer not be terminated in a location exposed to sea water, since the steel immediately adjacent the clad layer will sustain severe selective attack.

It is also pointed out that where steel structural members are to be joined, such as by butt welding, copper alloy clad or sheath provided for protection at the surface of the steel members must be thoroughly removed from the zone adjacent the weld of the steel structures in order to prevent dilution of the steel by copper from resulting during the welding procedure, thus developing an extremely brittle martensitic zone at this point which subsequently results in cracking or structural failure. It is also important, in the welding procedure used in making the butt weld, that iron dilution of the outer protective alloy layer does not occur so as to impair its corrosion resistant characteristic. Such dilution also deleteriously affects the hot ductility behavior of the bimetallic structure produced.

In prior attempts to protect a splash zone-exposed steel substrate by the use of protectively applied nickel-copper alloys, a cladding or sheathing material from 0.050 to 0.25 inch thick has generally been used, and has been attached to the steel substrate by welding. Such bimetallic structures have not performed entirely satisfactorily. The welding involved in such systems is a difficult procedure, and it is very important to avoid mixing the steel and alloy material, since the problems described by Newcombe are then encountered. Moreover, the thin sheath provided in such methods is easily damaged both during fabrication, and later during service from floating objects that may be impacted upon the structural or piping members.

Another problem encountered in bimetallic structures of the type which include a non-ferrous metal sheath is that where the structure is a tubular hot product line, usually known as a riser, the different coefficients of thermal expansion which characterize the clad or sheath material from that which characterizes the steel tubing allows severe mechanical stresses to be developed in the structure as temperature changes occur. The coefficient of thermal expansion for steel is about $6.5\times10^{-6}$ inch/inch/°F., for nickel-copper alloys approximately $14.0\times10^{-6}$ inch/inch/°F., and for copper-nickel alloys, approximately $10.0\times10^{-6}$ inch/inch/°F. Considering the large vertical dimension which may characterize the splash zone as hereinbefore mentioned, it will be perceived that the differential expansion as between the sheath or cladding material and the steel tubular substrate can be significant in the case of such hot product line risers. This can result in severe buckling and rupture of the sheath, and this is aggravated unless the sheath has been carefully and properly bonded to the steel.

BRIEF DESCRIPTION OF THE PRESENT INVENTION

The present invention provides an improved bimetallic structure which is constructed to facilitate maximum protection of a steel substrate with a non-ferrous metal clad or sheath. Such clad or sheath is applied to the substrate to minimize deleterious penetration of each type of metal by the other in the course of the welding steps, and to provide primary and secondary seals to insure against the seepage of sea water through the structure to welds at which accelerated corrosion can then occur as a result of a high potential difference between the clad or sheathing material and the substrate.

Broadly described, the corrosion resistant bimetallic structure of the invention comprises a steel substrate to be protected, at least one corrosion resistant, non-ferrous metal joined to a substrate surface area to be protected by cladding or by appropriate welds at opposite ends of a sheath, and a bridging element secured to the exposed outer side of the clad or sheath material, and projecting beyond a terminal edge of the sheath material in a plane spaced from the steel substrate. This space is filled with a secondary sealing material, such as an epoxy grout. In one specific embodiment of the invention, the protected steel substrate includes a pair of butt welded steel structures placed in end-to-end relation, and each having a protected surface extending to the weld. A pair of spaced, protective layers (in the form of cladding or a sheath) of a corrosion resistant, non-ferrous metal are joined to portions of the protected surface of each of the two steel structures at locations on opposed sides of the butt weld. A non-ferrous metal bridging plate positioned to bridge across the butt weld is joined to exposed outer surfaces of the spaced, protective layers by welding using weld metal which is predominantly the non-ferrous corrosion resistant metal used in the protective layers. In this form of the invention, the space between the bridging plate, the spaced ends of the protective layers and the steel substrate structures adjacent the butt weld is sealed against the ingress of corrosive fluids.

In another of its aspects, the invention is further directed to the method of making the described bimetallic corrosion resistant structures.

An important object of the invention is to provide a method of protecting a steel substrate which wll provide protection against the severe corrosion problems encountered in a marine splash zone environment.

A more specific object of the invention is to provide a leak-free, electrochemically compatible protective sheath system to be applied to risers and other steel structural members of the type used in off-shore oil and gas exploration and production structures.

An additional object of the invention is to provide a bimetallic structural member in the form of end-to-end butt jointed steel structural elements protected by a non-ferrous corrosion resistant clad or sheath system in which weakening of the cladding material and of the steel substrate elements as a result of migration of one metal into the other is minimized.

An additional object of the invention is to provide an easily constructed, mechanically strong bimetallic joint which is resistant to corrosion resulting from intermittent contact with salt water and air.

Additional objects and advantages of the invention will become apparent as the following detailed description of a preferred embodiment of the invention is read in conjunction with the accompanying drawings which illustrate such preferred embodiment.

GENERAL DESCRIPTION OF THE DRAWINGS

DETAILED DESCRIPTION OF A PREFERRED EMBODIMENT OF THE INVENTION

Figure 1:
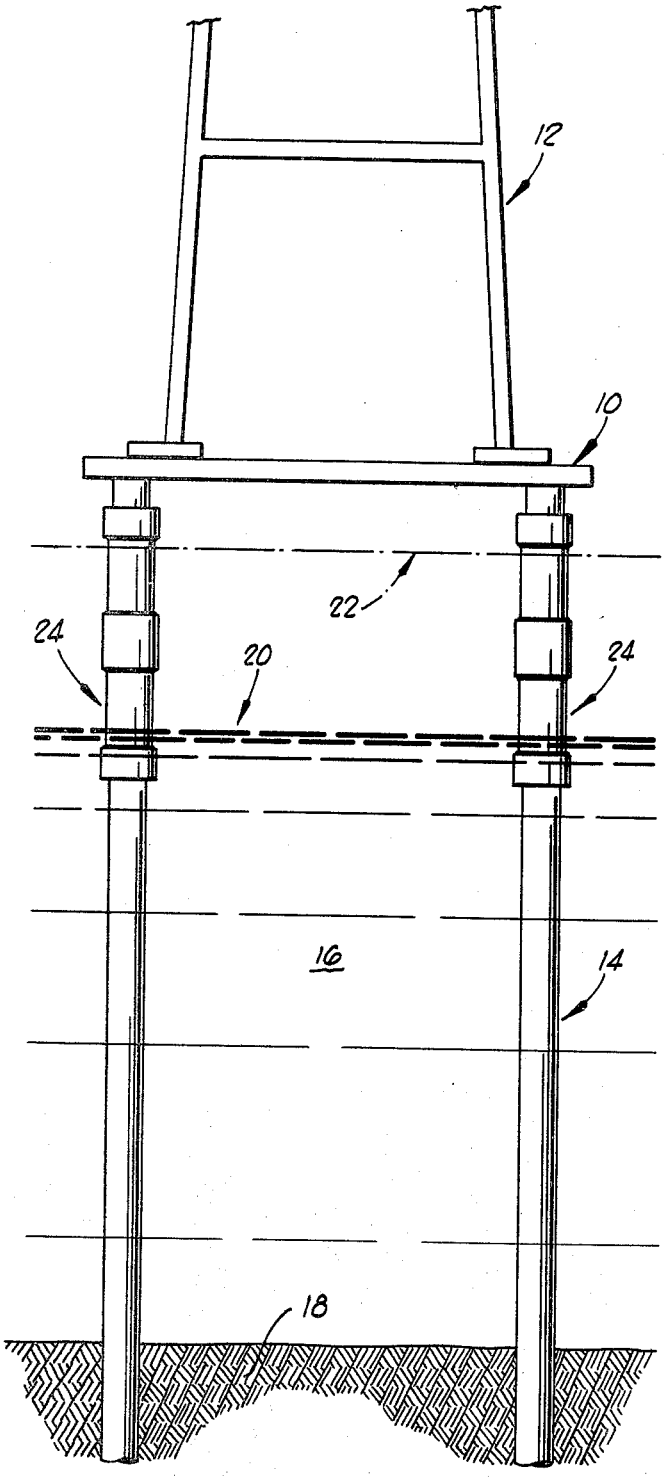
FIG. 1 is a side elevation view, in somewhat diagrammatic form, of an off-shore drilling platform showing certain structural elements used to support the platform as they are constructed in accordance with the present invention.

A marine (off-shore) structure useful in the exploration for undersea hydrocarbon deposits, or for producing the hydrocarbons from a marine situs, generally includes a horizontally extending platform 10 supported above the water, a mast or derrick 12 supported on the platform for mounting a draw works or other structure used in well drilling or oil or gas production, and some type of pilings or supporting elements which project from the platform to the ocean floor, and function to provide stability and support to the rig. In FIG. 1, the structures used to support the platform 10 and derrick 12 are shown as including a plurality of tubular steel pilings 14 which extend from the platform beneath the surface of the sea 16 and into the sea floor 18 to a depth sufficient to assure the required stability and support.

The surface of the sea or ocean as shown at 20 in FIG. 1 is assumed to represent the surface level at low tide. The location of the surface at high tide is represented by the dashed line 22. The splash zone hereinbefore described thus extends from the surface 20 to a location sufficiently above the line 22 to take into account the potential height of waves which may be generated at high tide under windy or stormy conditions. Each piling 14 includes a bimetallic joint 24 constructed in accordance with the present invention.

Figure 2:
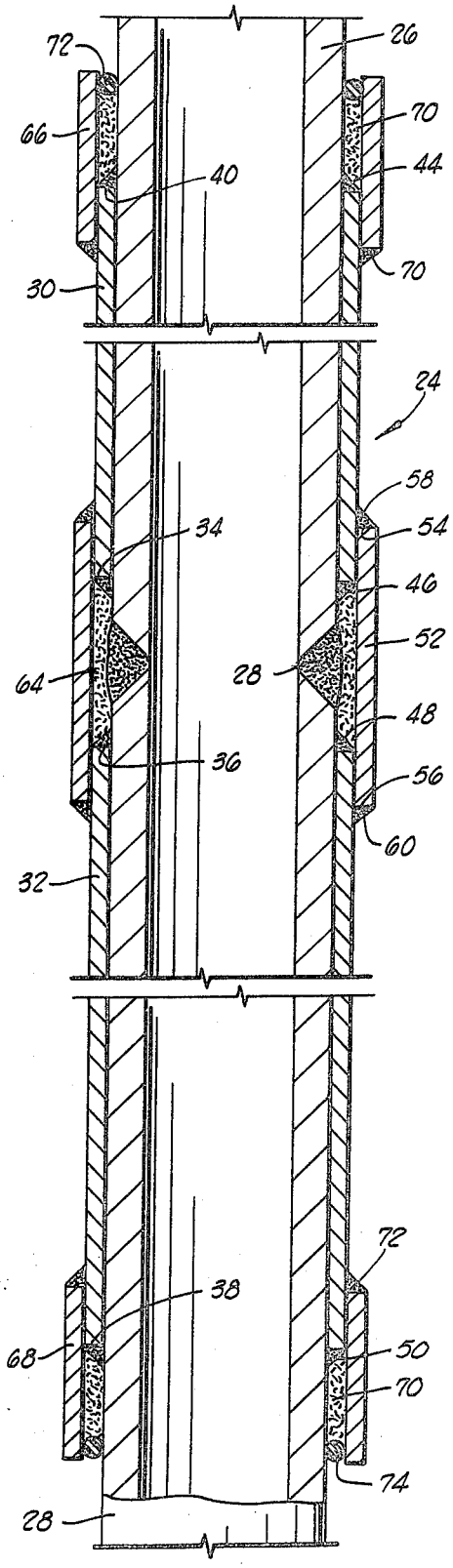
FIG. 2 is an enlarged detail view, in section, illustrating a bimetallic joint structure constructed in accordance with the present invention, and used in the off-shore platform depicted in FIG. 1.

The bimetallic joint 24 is illustrated in structural detail in FIG. 2. The joint 24 includes a pair of steel tubular piling elements or structures 26 and 28 which are aligned in end-to-end relation, and are joined by a butt weld 28. Because of the manner in which the bimetallic structure of the present invention is constructed, standard butt welding procedures can be used to form the butt weld 28 without concern for contact with the non-ferrous cladding or sheathing material, and without fear of contact of sea water with the butt weld at any time.

After the tubular piling elements 26 and 28 are joined by butt welding in the manner described, a portion of the exposed outer surfaces of each of these members lying within the splash zone is protectively covered or encased by a concentrically mounted sleeve of non-ferrous, corrosion resistant metal. The two sleeves 30 and 32 secured around the tubular elements 26 and 28 terminate at end faces 34 and 36, respectively, each axially spaced from the butt weld 28. The lower end 38 of the lower sleeve 32 is located so that it is submerged beneath the surface of the sea at low tide, and thus lies outside the splash zone. The upper end of the sleeve 30 is preferably terminated at a location above the reach of the largest waves likely to be developed during high tide.

Depending upon whether the protective sleeves 30 and 32 are applied to the steel substrate as a clad or as a sheath, joinder may be effected in different ways. The manner of bonding a cladding of this type to a steel substrate is well understood in the art. Where a non-ferrous corrosion resistant sheath is utilized, however, the sleeves 30 and 32 are attached to the steel tubular elements 26 and 28 by fillet welding at the opposed upper and lower ends of each of the sleeves to join the sleeves to the steel substrate. This sheath type of protective encasement is illustrated in FIG. 2.

In a preferred embodiment of the invention, the sleeves 30 and 32 are copper-nickel or nickel-copper alloy. Such alloys are widely used for cladding and sheathing, and their composition is well known in the art. Typically, a copper-nickel alloy of a type widely used may contain 70 weight percent copper and 30 weight percent nickel. A nickel-copper alloy may typically contain 70 weight percent nickel and 30 weight percent copper. Though such alloys are preferred for use in the bimetallic structure of the present invention, other protective non-ferrous corrosion resistant metals and alloys can be utilized within the principles of the invention.

Where the copper-nickel alloy sheathing is used in the construction of the sleeves 30 and 32, the welds made between the ends of the sleeves and the steel substrate, and shown at 44, 46, 48 and 50 in FIG. 2, are formed from a weld material which is electrochemically compatible with the sheathing alloy and with the steel substrate material. Preferably, a nickel or nickel-rich weld deposit is used for joining the sleeves 30 and 32 to the steel tubular elements 26 and 28 at these locations.

As previously explained, it is important that the points at which the cladding or sheathing material is joined to the steel substrate not be exposed to the corrosive environment (i.e., salt water, spray and air). In order to protect these locations from such exposure, protective bridging plates are employed. Thus, at the location of the butt weld 28 and the fillet welds 46 and 48, the bridging plate used is formed as a sleeve or collar 52 which bridges across the facing ends of the protective sleeves 30 and 32, and thus covers these weld points. The bridging sleeve 52 is made of the same non-ferrous, corrosion resistant metal or alloy as the sleeves 30 and 32. At its upper and lower ends 54 and 56, the bridging sleeve 52 is joined to the sheath sleeves 30 and 32 by welding at points 58 and 60 with weld metal which is substantially the same as the non-ferrous alloy used in the bridging sleeve 52, and in the two protective sheath sleeves 30 and 32.

It should be pointed out that it is desirable, though not critically essential, that further protection be provided against seepage of sea water past the welds 58 and 60 to the interior of the bridging sleeve 52, and ultimately to the locus of the welds 46 and 48 and butt weld 28. This is accomplished in the illustrated embodiment of the invention by filling the space inside the bridging sleeve 52 and between the ends 34 and 36 of the sheath sleeves 30 and 32 with a filler material 64 constituting a secondary seal. The filler material 64 used can be variously constituted, but preferably is an epoxy grout. A useful epoxy grout is epoxy resin filled with a metal powder or calcium carbonate. The metal powder used as a filler in the grout is preferably electrochemically similar to the non-ferrous metal used in the protective sheath sleeves 30 and 32 and bridging sleeve 52. Where calcium carbonate is used as a filler for the epoxy resin, it functions dually in affording protection against leaks, and in protecting the steel substrate in the event leakage should occur.

Another route by which leakage of sea water can occur in a manner to contact steel in the splash zone to thereby engender corrosion is via the respective upper and lower ends of the sheath sleeves 30 and 32. In order to provide an effective barrier at these locations against such leakage, additional protective bridging sleeves 66 and 68 are provided. As in the case of the bridging sleeves 52, the bridging sleeves 66 and 68 are welded to the protective sheath sleeves 30 and 32, as shown at 70 and 72, respectively. Such welding is accomplished using weld metal which is substantially the same in constitution as the non-ferrous metal employed in the sheath sleeves 30 and 32 and the bridging sleeves 60 and 68. The bridging sleeves 66 and 68 are secured around the sheath sleeves 30 and 32 at locations such that a portion of each of these bridging sleeves projects beyond the respective end of the sheath sleeve upon which it is located, and concentrically surrounds, and is spaced radially from, the respective steel tubular element 26 or 28. These annular spaces are then filled with an epoxy grout 70 or other suitable secondary seal material. Inflatable packers or O-ring seals 72 and 74 are used to provide the primary seals at the open ends of the annular spaces in which the epoxy grout 70 is located.

It will be perceived that the bimetallic joint structure as thus fabricated provides a protected structure in which the steel substrate is completely shielded from contact with the deleterious corrosive conditions existing within the splash zone. No part of the pilings 14 which traverse the splash zone are so exposed, since the sheathing material completely encloses and protects the underlying steel structural elements at this location. Further, it will be perceived that the selective manner in which welding is accomplished, and the location at which the welds are located, assures minimization of migration of steel into the non-ferrous protective material or vice versa, thus causing a weakening of the bimetallic structure. The clads or sheaths are terminated at locations spaced axially from the butt weld 28. Therefore, in cases where this operation of joinder of the two tubular elements 26 and 28 is accomplished after cladding or sheathing has been carried out, completing the butt weld does not cause fusion of the ends of the sheaths in such a way that undesirable contamination of the steel substrate occurs.

It should be pointed out that although one form of the present invention has been illustrated in FIGS. 1 and 2 for purposes of typifying and exemplifying the bimetallic, corrosion resistant structure of the invention, the principles of the invention may be utilized in other forms of bimetallic structures. For example, where joining or connection of steel structural elements is not required within the splash zone, a single continuous protective sleeve or clad may be applied over an extended length of the steel structural member, with such protective sleeve or clad being terminated at its upper and lower ends by the use of bridging sleeves of the sort denominated by reference numerals 66 and 68 in the drawings. It will also be appreciated that flat stock as well as tubular stock can be beneficially protected by the use of cladding or sheathing overlays applied in accordance with the principles of the invention herein enunciated.

It will therefore be appreciated that though the bimetallic corrosion resistant structure of the present invention has been illustrated and described with particular reference made to one preferred, specific form which the invention can assume, other forms of construction can be used which equally benefit from the principles of the invention to achieve the objectives herein described. Variations and changes of this sort, if based upon the principles described, are therefore deemed to be circumscribed by the spirit and scope of the invention, except as the same may be necessarily limited by the appended claims or reasonable equivalents thereof.

The embodiments of the invention in which an exclusive property or privilege is claimed are defined as follows:

1. A corrosion resistant bimetallic structure comprising:

a steel structural element;

a corrosion resistant, non-ferrous metal overlay joined to said steel structural element and positioned over, and in contact with, a surface area to be protected on the element, said non-ferrous metal including a terminal edge;

at least one corrosion resistant non-ferrous metal bridging element secured to an exposed surface of said non-ferrous metal overlay on the opposite side thereof from its side in contact with the steel structural element, and including a portion projecting beyond said terminal edge and spaced from said steel structural element; and sealing means in the space between said bridging element portion and said steel structural element for preventing ingress of a corrosive fluid through said space to said terminal edge.

2. A corrosion resistant bimetallic structure as defined in claim 1 wherein said steel structural member comprises:

a pair of steel structural elements welded to each other in end-to-end relation with the weld therebetween positioned under said bridging element; and wherein said bimetallic structure includes a pair of said overlays spaced from each other on opposite sides of the weld joining said steel structural elements, and each having a first terminal edge thereof positioned under said bridging element, and each having a second terminal edge.

3. A corrosion resistant bimetallic structure as defined in claim 1 wherein said sealing means comprises:

a primary seal sealingly positioned between said projecting element and said steel structural element; and an epoxy grout secondary seal positioned in said space and between said primary seal and said terminal edge.

4. A corrosion resistant bimetallic structure as defined in claim 1 wherein said overlay and said bridging element are each alloys of copper and nickel.

5. A corrosion resistant bimetallic structure as defined in claim 4 wherein said overlay is joined to said steel element by cladding.

6. A corrosion resistant bimetallic structure as defined in claim 4 wherein said bridging element is secured to said overlay by a weld of an alloy of copper and nickel.

7. A corrosion resistant bimetallic structure as defined in claim 1 wherein said overlay is a sheath and said structure further includes a weld joining said sheath to said steel structural element at said terminal edge.

8. A corrosion resistant bimetallic structure as defined in claim 7 wherein said sheath is an alloy of copper and nickel, and said weld is a weld metal rich in nickel.

9. A corrosion resistant bimetallic structure as defined in claim 2 wherein said sealing means comprises an epoxy grout positioned between said bridging element and said steel structural elements, and between the terminal edges of the overlays in said pair.

10. A bimetallic structure as defined in claim 2 wherein said bimetallic structure further comprises:

a second non-ferrous metal bridging element secured to a surface of one of said overlays on the opposite side thereof from a side in contact with one of the steel structural elements, and including a portion projecting beyond the second terminal edge of said one overlay and spaced from said one steel structural element;

second sealing means in the space between said second bridging element and said one steel structural element;

a third non-ferrous metal bridging element secured to a surface of one of the other of said overlays on the opposite side thereof from its side in contact with the other of said steel structural elements, and including a portion projecting beyond the second terminal edge of said other overlay and spaced from said other steel structural element; and third sealing means in the space between said second bridging element portion and said other steel structural element.

11. A bimetallic structure as defined in claim 10 wherein each of said sealing means comprises an epoxy grout.

12. A bimetallic structure as defined in claim 10 wherein each of said overlays and bridging elements is an alloy of copper and nickel.

13. A bimetallic structure as defined in claim 12 wherein said overlays are bonded to said steel structural elements by nickel rich welds.

14. A bimetallic structure as defined in claim 12 wherein said bridging elements are welded to said overlays with welds consisting of said alloy.

15. A bimetallic joint resistant to salt air and salt water corrosion encountered in a marine splash zone environment comprising:

a pair of steel structural elements joined at adjacent edges by a weld; and a corrosion resistant alloy encasement structure sealingly and protectively overlying the weld and protected portions of said steel structural elements on opposite sides of the weld, said encasement structure including:

a first corrosion resistant non-ferrous metal overlay joined to one of said steel structural elements and positioned over, and in contact with, a surface area of said one steel structural element which is spaced from said weld;

a second corrosion resistant non-ferrous metal overlay joined to the second of said steel structural elements and positioned over, and in contact with, a surface area of said second steel structural element which is spaced from said weld; and a bridging element of said corrosion resistant non-ferrous metal extending between, bridging and joined to said first and second overlays, and spaced from said steel structural elements and weld; and sealing means preventing water from passing to any location between said encasement structure and said steel structural elements.

16. A bimetallic joint as defined in claim 15 wherein said non-ferrous metal of said overlays and said bridging element is an alloy of copper and nickel.

17. A bimetallic joint as defined in claim 15 wherein said sealing means comprises:

an elastomeric primary seal; and a grout secondary seal.

18. A bimetallic joint as defined in claim 15 wherein said steel elements are tubular, said overlays are sleeves each surrounding one of the tubular steel elements and said bridging element is a sleeve.

19. A method of constructing a corrosion resistant joint comprising:

welding a pair of steel elements in end-to-end alignment;

encasing sections of each steel element spaced from the weld with a pair of spaced corrosion resistant non-ferrous metal encasements having terminal edges disposed on opposite sides of the weld;

sealing said terminal edges of the encasements to the steel elements at locations spaced from the weld; and protectively enclosing said sealed terminal edges under a non-ferrous metal bridging plate by welding using said non-ferrous metal for welding.

20. A method of constructing a corrosion resistant joint as defined in claim 19 and further characterized as including the step of filling the space between said terminal edges and over said weld with an epoxy grout.

* * * * *